US005594532A

United States Patent [19]

Tuvesson et al.

[11] Patent Number: 5,594,532

[45] Date of Patent: Jan. 14, 1997

[54] CARTRIDGE, CARTRIDGE CLEANING APPARATUS AND METHOD FOR CLEANING A CORONA WIRE

[75] Inventors: Eric Tuvesson, Moorpark; Efrem Lipetsky, Northridge, both of Calif.

[73] Assignee: Dataproducts Corporation, Simi Valley, Calif.

[21] Appl. No.: 404,558

[22] Filed: Mar. 15, 1995

[51] Int. Cl.[6] ..... G03G 21/00; G03G 15/02

[52] U.S. Cl. ..... 399/100; 250/324

[58] Field of Search ..... 355/215, 219, 355/221, 225; 250/324, 325, 326

[56] References Cited

U.S. PATENT DOCUMENTS

| | | | |
|---|---|---|---|
| 3,842,273 | 10/1974 | van Buskirk | 355/215 |
| 3,875,407 | 4/1975 | Hayne | 355/215 |
| 3,891,846 | 6/1975 | Ito | 355/215 |
| 3,965,400 | 6/1976 | Tolliver | 355/215 |
| 3,978,379 | 8/1976 | del Vecchio | 355/215 |
| 4,038,546 | 7/1977 | Jasinski | 250/324 |
| 4,566,777 | 1/1986 | Honda et al. | 355/297 |
| 4,603,964 | 8/1986 | Swistak | 250/325 X |
| 4,734,580 | 3/1988 | Rodrigo et al. | 250/324 |
| 4,788,573 | 11/1988 | Nakaoka et al. | 355/215 |
| 4,864,363 | 9/1989 | Shinada | 355/221 X |
| 4,885,466 | 12/1989 | Koichi et al. | 355/215 X |
| 4,956,671 | 9/1990 | Otsuka | 355/215 |
| 5,023,748 | 6/1991 | Okamoto et al. | 361/229 |
| 5,089,850 | 2/1992 | Ogura et al. | 355/215 |
| 5,182,694 | 1/1993 | Endo | 361/229 |
| 5,185,630 | 2/1993 | Nagasawa et al. | 355/215 |
| 5,250,991 | 10/1993 | Ikeda | 355/215 |
| 5,392,099 | 2/1995 | Kusumoto et al. | 355/221 |

OTHER PUBLICATIONS

IBM Technical Disclosure Bulletin—vol. 11, No. 8, Jan. 1969—p. 1025 Corona Unit Celaning Device.

HP LaserJet Series II, III printers "Cleaning the Primary Corona", pp. 6–16, 6–17, and 6–18.

Okidata OL400/800 printers "Cleaning the Charge Wire"; p. 106.

*Primary Examiner*—Fred L. Braun

*Attorney, Agent, or Firm*—Loeb & Loeb LLP

[57] ABSTRACT

An apparatus and method for cleaning a corona wire in a toner supply and a toner cartridge employing the apparatus and method for cleaning a corona wire. The apparatus and method allow a user to free the corona wire from debris or excess toner without interrupting the use of a printer for long periods of time. The apparatus includes toner cartridge, a housing for the corona wire, and a compact cleaning cartridge tool. The cartridge cleaning tool further includes a cleaning support element, a cleaning element, a handle and a hook element.

18 Claims, 6 Drawing Sheets

CARTRIDGE, CARTRIDGE CLEANING APPARATUS AND METHOD FOR CLEANING A CORONA WIRE

FIELD OF THE INVENTION

This invention relates to an apparatus and method for cleaning a corona wire in a toner supply, such as a toner cartridge for a printer, facsimile machine, or copy machine, and to a toner cartridge employing a corona wire cleaning apparatus and method.

BACKGROUND OF THE INVENTION

The popularity of stand-alone printers has increased with the increased demand for document printing in, for example, the work place, home, or a government office. Indeed, stand-alone printers are relied upon to produce a variety of printed documents, such as reports, letters, legal papers, government documents and even homework assignments. In many contexts, a user may rely on such printers to produce clean, smudge-free documents with clear and well defined printed text and/or graphics. Such printers typically employ a toner supply device (such as a toner cartridge) provided with a corona wire for image formation processing.

A problem that has confronted many printer users is the accumulation of excess toner and other debris on the corona wire. These accumulations can deteriorate the print quality and can interrupt the continuous use of these printers by causing print defects, such as smudging and/or dark streaks on the printed pages. In some cases, technicians were called to remove the toner or debris that was causing print defects on the printed pages. This required printer down time as well as technician expenses.

In many instances, the problem simply required that toner or other debris be wiped from the small thin corona wire in the printer toner cartridge. To address this simple problem and allow maximum working time, tools were developed that allowed the user or technician to clean the corona wire without disabling the printer for long periods of time.

One such tool has been incorporated in an IBM Laser-Printer Series toner cartridge distributed under part No. 1380520 (see FIG. 1). The IBM cartridge utilizes a long, narrow, plastic arm 74 that extends the width of the printer cartridge (i.e., the length of the corona wire 75). A seat 76 resides at one end of the arm 74. The seat 76 houses a felt piece 78 that wraps around the corona wire. The other end of the long arm 74 includes a handle 80 that protrudes to the outside of the printer cartridge, allowing the user to access and manipulate the long, narrow, plastic arm 74. When the corona wire needs to be cleaned, the user or technician holds the handle 80 and pulls the long, narrow, plastic arm 74 out from the side of the printer cartridge, causing the felt piece 78 to slide along the length of the corona wire. As the felt piece 78 slides along the corona wire, toner or other debris accumulated on the corona wire adheres to the felt piece or is pushed off of or along the wire.

To use this device, the printer must be positioned such that the plastic arm can be pulled out from the side of the printer cartridge by a distance at least the length of the corona wire. Thus, there must be space, at least the length of the corona wire, on one side of the printer. Further, the relatively long length dimension of the lever arm, from the handle to the seat, results in a lever action which has a propensity for imparting a relative large force on the corona wire, which may be subject to breakage.

Other types of cleaning tools include a member which is pressed upward against the wire for the purpose of cleaning the corona wire, as described in U.S. Pat. No. 4,788,573 to Nakaoka et al. In such designs, the pressure force imparted by the upward pressing of the tool must be predetermined and controlled so as not to break the corona wire.

SUMMARY OF THE DISCLOSURE

An object of preferred embodiments of the present invention is to provide a more stable and compact cartridge cleaning tool that allows an end user to easily free the corona wire from toner or debris such that print defects are avoided. Embodiments of the present invention not only achieve these objectives, but also are not prone to the same problems associated with the above-discussed prior cleaning tools.

Embodiments of the present invention comprise a toner cartridge, a housing for the corona wire, and a compact cartridge cleaning tool. The cartridge cleaning tool further comprises a cleaning element, a cleaning element support, a hook or clasp element and a handle. In some preferred embodiments, the cleaning element support houses a felt piece that wipes the wire as the tool is slid along the wire.

BRIEF DESCRIPTION OF THE DRAWINGS

The detailed description of the embodiments of the invention will be made with reference to the accompanying drawings, wherein like numerals designate corresponding parts in the figures.

DETAILED DESCRIPTION OF THE PREFERRED EMBODIMENTS

As noted above, this invention relates to an apparatus and method for cleaning a corona wire in a toner supply, such as a toner cartridge for a printer, facsimile machine, or photocopy machine. For purposes of simplifying the present disclosure, the following discussion relates to toner cartridges in printers. However, it will be understood that further embodiments of the invention may be employed for cleaning a corona wire on other systems, such as, for example, facsimile machine and photocopy machines.

Figure 1:
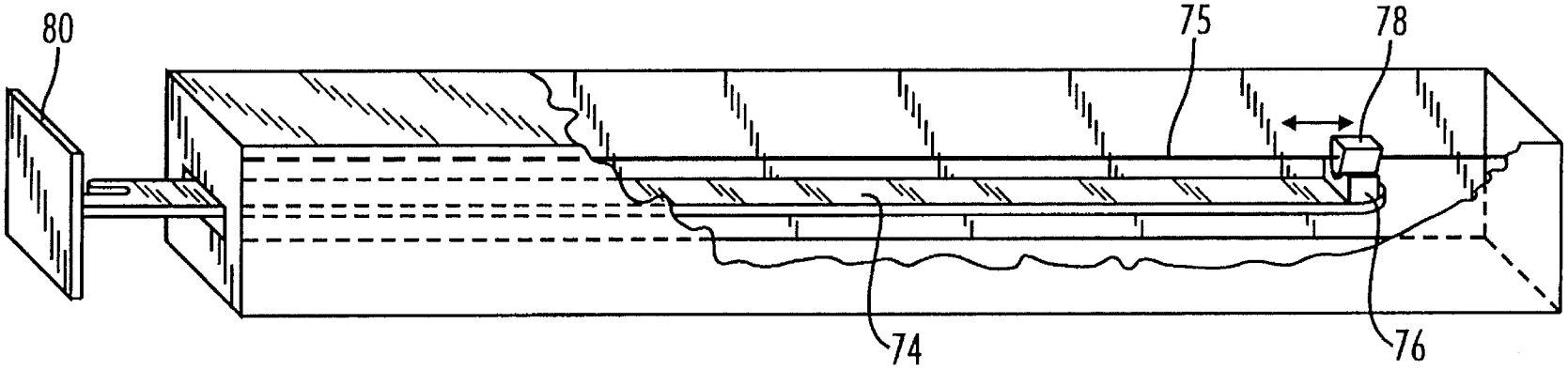
FIG. 1 PRIOR ART
FIG. 1 depicts the prior art embodiment of a cleaning tool with an elongated handle that is pulled out of the cartridge.
Figure 2A:
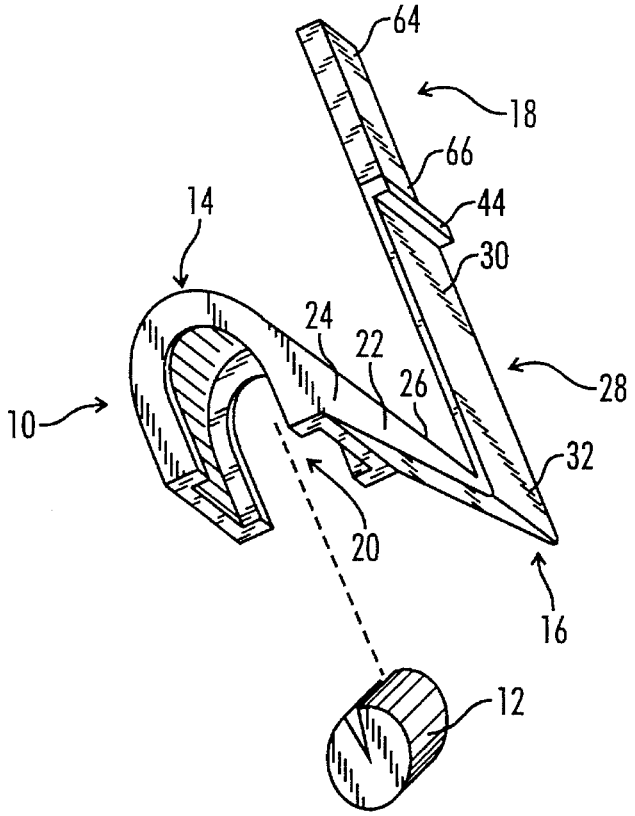
FIG. 2*a* depicts a preferred embodiment of a cartridge cleaning tool.
Figure 2B:
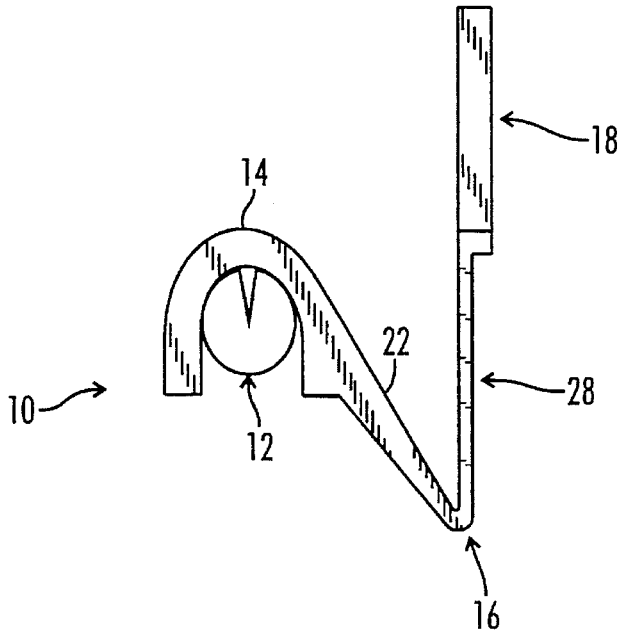
FIG. 2*b* depicts a side view of a cartridge cleaning tool.

FIGS. 2*a* and 2*b* depict a preferred embodiment of the cartridge cleaning tool 10. Generally, the embodiment of the cleaning tool 10 comprises a cleaning element 12, a cleaning element support 14, a hook or clasp element 16 and a handle 18.

The cleaning element support 14 is a hollow body having a receiving and supporting portion 20 for the cleaning element 12. In preferred embodiments, the cleaning element support is a unitary structure having a general "U" shape. However, further embodiments may have other shapes suitable for receiving and retaining a cleaning element 12.

The cleaning element 12 is shaped to fit into the receiving and supporting portion 20 of the cleaning element support 14. In preferred embodiments, the cleaning element 12 comprises a piece of felt. However, further embodiments may employ other material suitable to clean toner or other printer debris from a corona wire suffices.

The hook or clasp element 16 further comprises a first leg 22, having a first end 24 and a second end 26, and a second leg 28, having a first end 30 and a second end 32. The hook or clasp element 16 connects the cleaning element support 14 and the handle 18.

The first end 24 of the first leg 22 is coupled to (or, preferably, contiguous with) the cleaning element support 14. The first end 30 of the second leg 28 is coupled to (or, preferably, contiguous with) the handle 18. The second end 26 of the first leg 22 and the second end 32 of the second leg 28 are coupled or, preferably, contiguous with each other and form an angle or hook 16.

The handle or tab 18 further comprises a first end 64 and a second end 66. The second end 66 of the tab is coupled to (or, preferably, contiguous with) the first end 30 of the second leg 28. The tab 18 is thicker than the second leg 28 such that a ridge 44 is formed at the juncture of the tab 18 and the first end 30 of the second leg 28. The first end 64 of the handle 18 facilitates the operation of the cleaning tool 10 as discussed below.

Figure 3A:
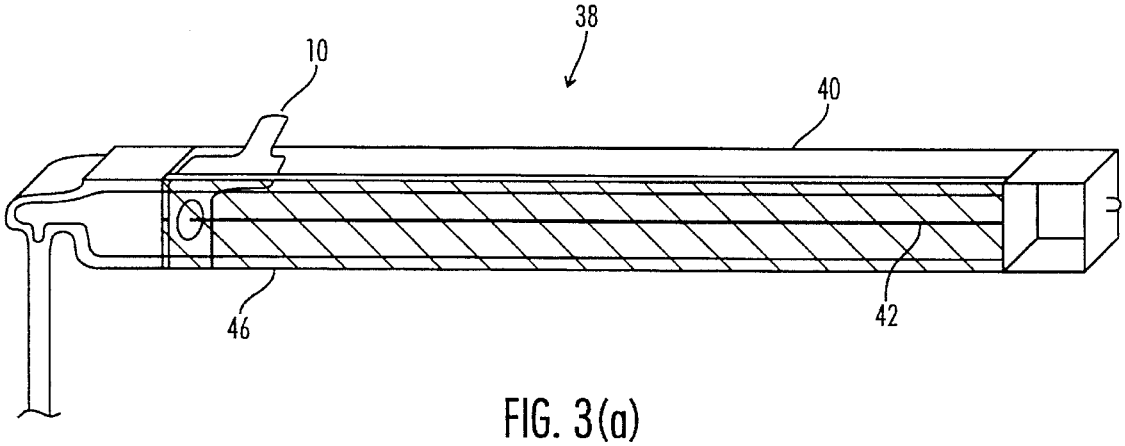
FIG. 3*a* illustrates one of the preferred embodiments of the present invention with the cartridge cleaning tool in its initial position.
Figure 3B:
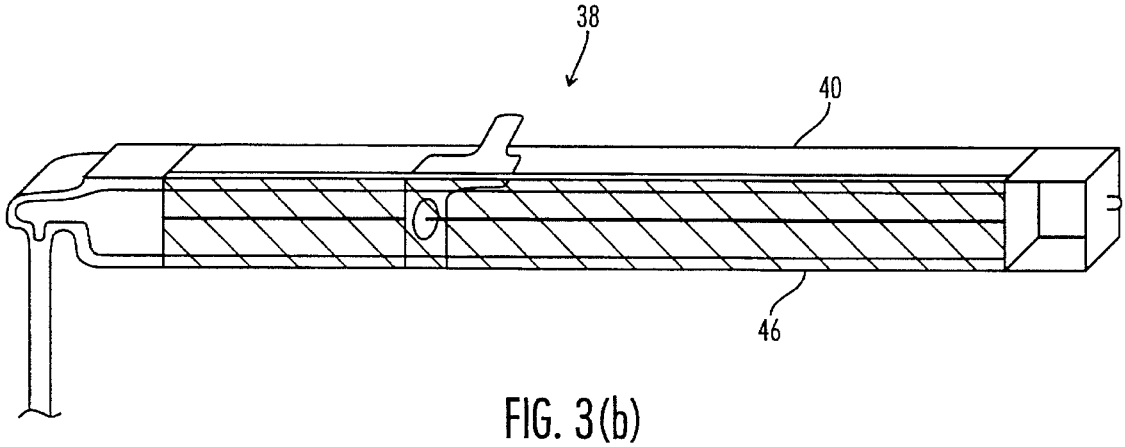
FIG. 3*b* illustrates one of the preferred embodiments of the present invention with the cartridge cleaning tool in a position along the corona wire.

FIG. 3*a* depicts a preferred embodiment of a main charger assembly 38 with the cartridge cleaning tool 10 in its initial position. The main charger assembly comprises an elongated main housing unit 40, wherein a corona wire 42 and the cleaning tool 10 reside. A screen or mesh lid 46 is provided on the housing. The corona wire 42 extends in the longitudinal direction of the main charger assembly 38. FIG. 3*b* depicts a preferred embodiment of a main charger assembly 38 with the cartridge cleaning tool 10 disposed centrally along the corona wire 42.

Figure 4A:
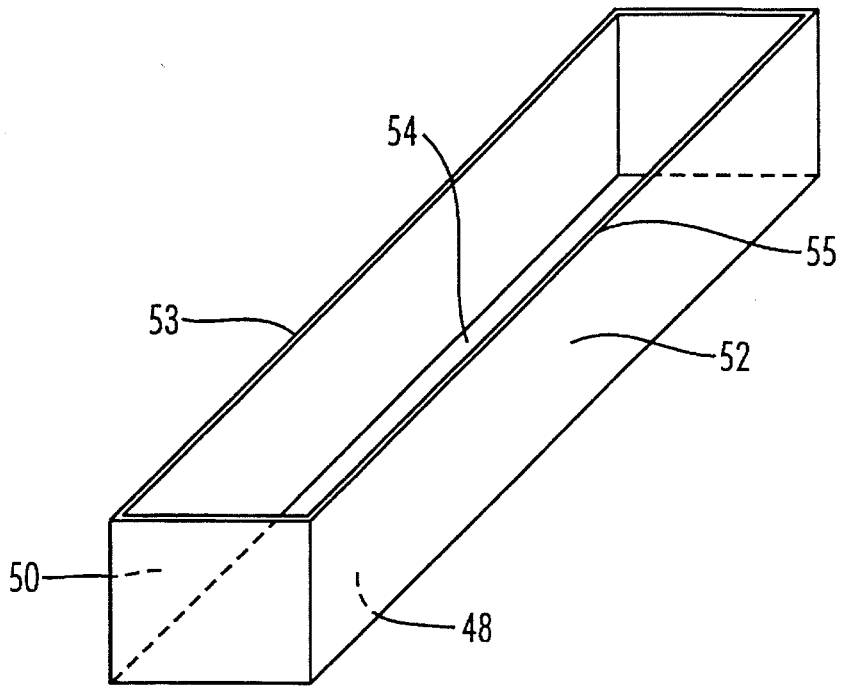
FIG. 4*a* depicts the main housing unit.

The main housing unit 40 is a three sided hollow box-like structure that further comprises a back side 48, a left side 50 and a right side 52 and defines an interior chamber 54. (See orientation in FIG. 4*a*) The left side 50 and right side 52 each have a lengthwise edge 53, 55 extending the longitudinal direction of the housing and reside in planes that are parallel to each other. The back side 48 resides in a plane that is perpendicular to the left side 50 and the right side 52, such that the back side 48 connects the left side 50 and the right side 52.

Figure 4B:
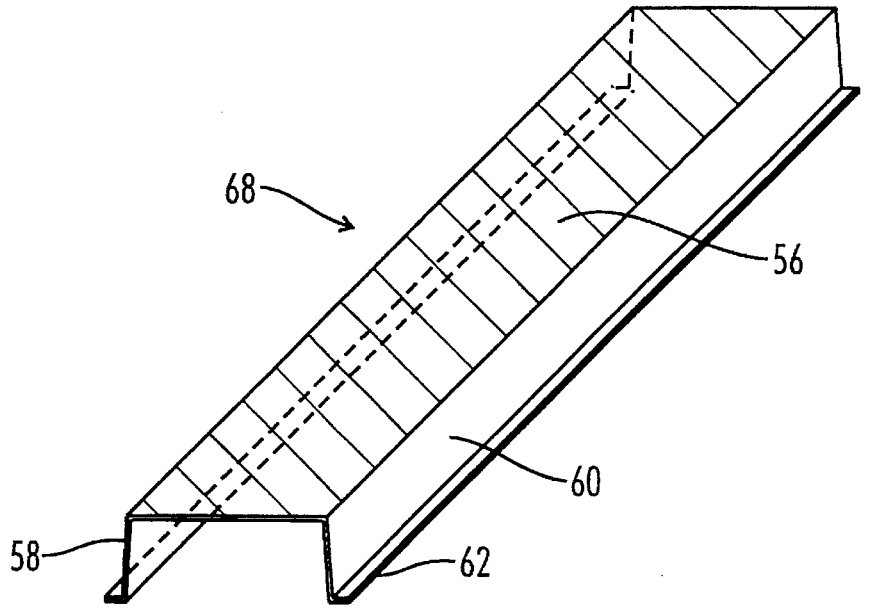
FIG. 4*b* depicts the top or lid that fits onto the main housing unit.

The lid 68, as shown in FIG. 4*b*, comprises a top side 56, a first side 58 and a second side 60. Each of the first side 58 and the second side 60 have a lip 62 spaced from the top side 56. The lid 68 is removably coupled with the main charger assembly 38, wherein the first side 58 abuts the left side 50 and the second side 60 abuts the right side 52.

Figure 2C:
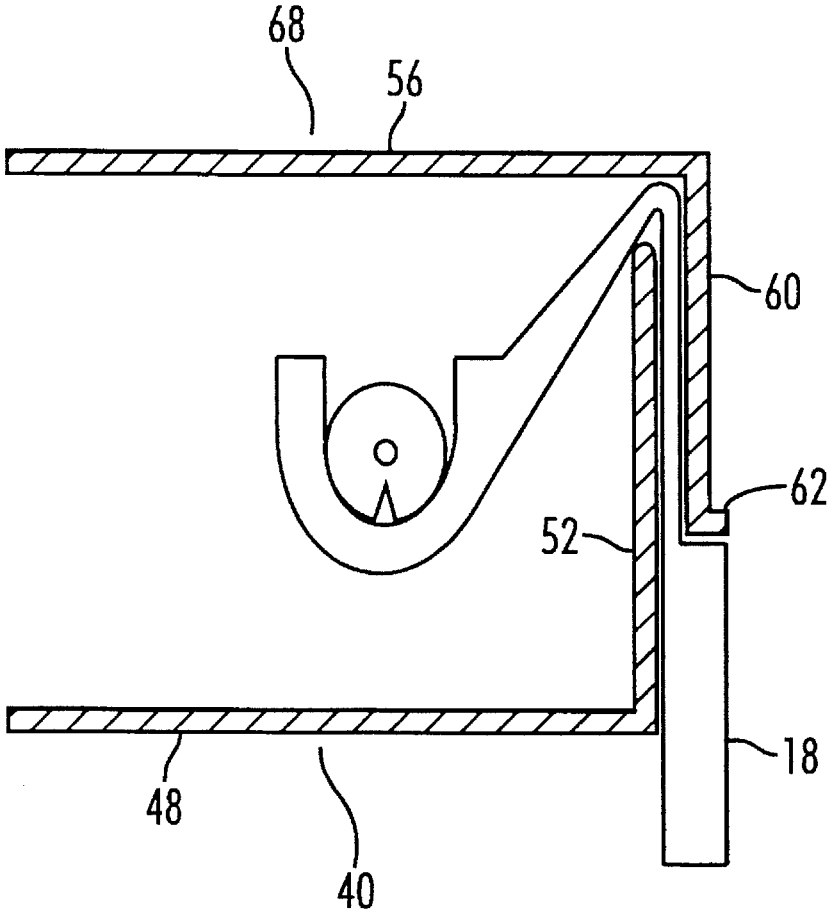
FIG. 2*c* depicts a cross-section of a preferred embodiment of a cartridge cleaning tool coupled to a main housing unit.

FIG. 2*c* depicts a cross-section of a preferred embodiment of a cleaning tool 10 coupled to the main housing unit 40. As shown in the figure, the hook or clasp element 16 slidably mates with the lengthwise edge 53 of the right side 52 of the main housing unit 40. The cleaning support 14 and cleaning element 12 extend into the interior chamber 54 of the housing 40 such that the cleaning element 12 engages the corona wire 42. The second leg 28 of the hook 16 abuts the right side 52. In other preferred embodiments, the hook or clasp element 16 slidably mates with the longitudinal edge of the left side 50 of the main housing unit 40. Once the tool 10 is slidably engaged with the longitudinal edge 53, the lid 68 is received by the main housing unit 40 such that the second side 60 abuts the second leg 28 of the cleaning tool 10. Thus, the second leg 28 of the cleaning tool 10 resides between the right side 52 of the housing 40 and the second arm 60 of the lid 68. Further, the lip 62 resides adjacent to the ridge 44. When coupled to the main housing unit 40, the lip 62 is approximately flush with the handle 18.

Figure 5:
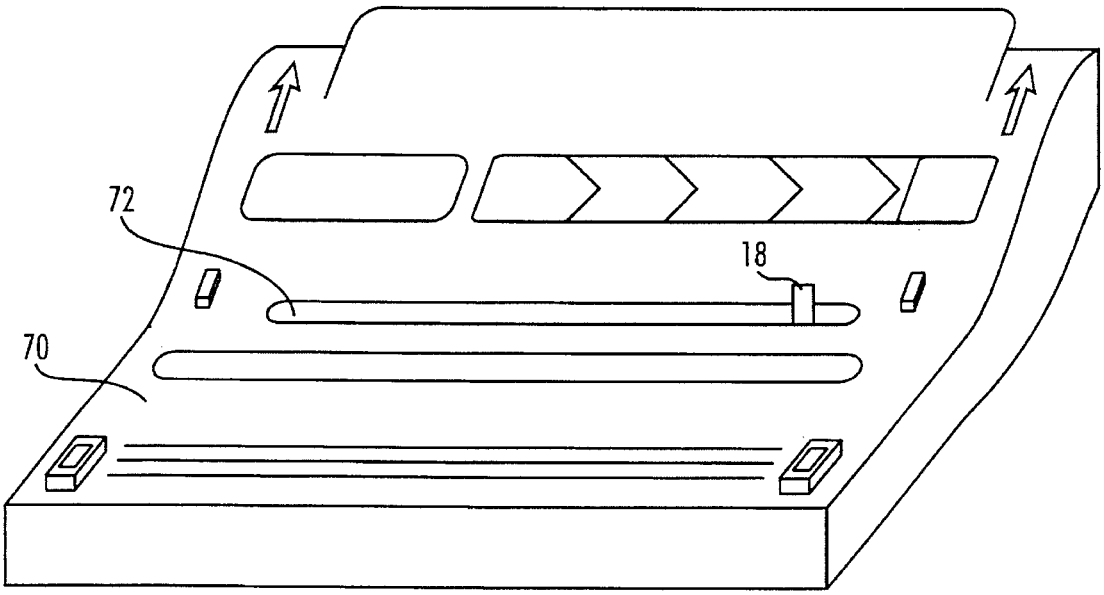
FIG. 5 illustrates a printer toner cartridge in which the cartridge cleaning tool of the invention is used.

In operation, the main charger assembly 38 resides in a toner cartridge, for example, a printer toner cartridge such as a Dataproducts LZR 15/20 (Compaq 15/20) or other suitable cartridge. As shown in FIG. 5, the cartridge comprises a cover 70 having a slot 72.

The cartridge cleaning tool 10 resides in the main housing unit such that the handle 18 mates with the slot 72 in the cartridge cover 70. The hook element 16 engages either the left side 50 or the right side 52 of the main housing unit 40 such that the cleaning support element 14 resides within the chamber 54 of the main housing unit 40. When the cleaning element 12 resides in the cleaning support element 14, the cleaning element 12 contacts the corona wire.

If streaks are experienced from the corona wire, the cartridge can be removed from the printer (or the printer housing opened) such that the handle 18 is exposed. The user can push the tool across the width of the cartridge such that the wire is wiped and cleaned by the cleaning tool 10.

Although the foregoing described the invention with preferred embodiments, this is not intended to limit the invention. Rather, the foregoing is intended to cover all modifications and alternative constructions falling within the spirit and scope of the invention as expressed in the appended claims.

What is claimed is:

1. A cartridge cleaning tool adapted for use with a main charger unit having a housing unit with a lengthwise edge, a corona wire extending through the housing unit, and a lid, wherein the housing unit and the lid define a lengthwise slit opening extending along the direction of the lengthwise edge of the housing unit, the cartridge cleaning tool comprising:

a cleaning element adapted to contact the corona wire, a cleaning support element for supporting the cleaning element, a handle, and a connecting portion coupling the cleaning support element and the handle, and configured to extend through the lengthwise slit opening and slidably mate with the lengthwise edge of the at least one side of the housing unit and the lengthwise slit opening.

2. A cartridge cleaning tool as recited in claim 1, wherein the cleaning support element of the cartridge cleaning tool further comprises an enclosure in which the cleaning element resides.

3. A cartridge cleaning tool as recited in claim 1, wherein the cleaning element is a piece of felt.

4. A cartridge cleaning tool as recited in claim 1, wherein the handle further comprises a first end, a second end, and a ridge, wherein the second end is adjacent to the connecting portion and the ridge is provided between the second end of the handle and the connecting portion.

5. A cartridge cleaning tool as recited in claim 1, wherein the connecting portion is hook shaped.

6. A cartridge cleaning tool as recited in claim 1, wherein the connecting portion of the cartridge cleaning tool further comprises:

a first leg having a first end and a second end, wherein the first end of the first leg is adjacent to the cleaning support element; and a second leg forming an angle with the first leg, the second leg having a first end and a second end, wherein the first end of the second leg is adjacent to the handle and wherein the second end of the first leg is adjacent to the second end of the second leg.

7. A cartridge cleaning tool adapted for use with a corona wire that resides in a housing for such wire, the housing defining at least one lengthwise edge extending in the longitudinal direction of the housing, the tool comprising:

a cleaning element adapted to contact the corona wire;

a cleaning support element for receiving and supporting the cleaning element;

a handle; and a hook element configured to slidably mate with the lengthwise edge of the housing;

wherein the hook element further comprises a first leg having a first end and a second end, wherein the first end of the first leg is adjacent to the cleaning support element, and a second leg forming an angle with the first leg, the second leg having a first end and a second end, wherein the first end of the second leg is adjacent to the handle and wherein the second end of the first leg and the second end of the second leg are adjacent.

8. A charger assembly for use in a toner cartridge, the charger assembly comprising:

a housing unit having a back portion, and at least one side portion having a lengthwise edge;

a corona wire extending longitudinally through the housing unit along the direction of the lengthwise edge;

a lid having a top portion and at least one side portion;

wherein the lid is coupled to the housing unit such that the at least one side portion of the housing unit is adjacent and spaced from the at least one side portion of the lid to define a lengthwise slit opening between the adjacent side portions of the housing unit and lid, the lengthwise slit opening extending along the direction of the lengthwise edge of the at least one side portion of the housing unit;

a cartridge cleaning tool having a cleaning element adapted to contact the corona wire, a cleaning support element for supporting the cleaning element, a handle, and a connecting portion coupling the cleaning support element and the handle, the connecting portion extending through the lengthwise slit opening between the spaced side portions of the housing unit and lid, the connecting portion being configured to slidably mate with the lengthwise edge of the at least one side portion of the housing unit and the lengthwise slit opening.

9. A charger assembly as recited in claim 8 wherein the at least one side portion of the housing unit comprises a first side portion and a second side portion, such that the first side portion of the housing unit is coupled to the second side portion of the housing unit by the back portion of the housing unit; and wherein the at least one side portion of the lid further comprises a first side portion and a second side portion, such that the first side portion of the lid is coupled to the second side portion of the lid by the top portion of the lid.

10. A charger assembly as recited in claim 9, wherein:

the first side portion and the second portion of the housing unit are in parallel planes, and the back portion of the housing unit is perpendicular and adjacent to the first side portion and the second side portion of the housing unit.

11. A charger assembly as recited in claim 9, wherein the first side portion and the second side portion of the lid are in parallel planes, and the top portion of the lid is perpendicular to the first side portion and the second side portion of the lid.

12. A charger assembly as recited in claim 9, wherein the first and second side portions of the lid further comprise a lip.

13. A charger assembly as recited in claim 8, wherein the cleaning support element of the cartridge cleaning tool comprises an enclosure in which the cleaning element resides.

14. A charger assembly as recited in claim 8, wherein the cleaning element is a piece of felt.

15. A charger assembly as recited in claim 8, wherein the handle has a first end, a second end, and a ridge, wherein the second end of the handle is adjacent to the connecting portion and the ridge is provided between the second end of the handle and the connecting portion.

16. A charger assembly as recited in claim 8, wherein the connecting portion is hook shaped.

17. A charger assembly as recited in claim 8, wherein the connecting portion of the cartridge cleaning tool further comprises:

a first leg having a first end and a second end, wherein the first end of the first leg is adjacent to the cleaning support element; and a second leg forming an angle with the first leg, the second leg having a first end and a second end, wherein the first end of the second leg is adjacent to the handle and wherein the second end of the first leg is adjacent to the second end of the second leg.

18. A method for cleaning a corona wire in a toner cartridge, comprising the steps of:

providing a main charger unit having a housing unit with a lengthwise edge, a corona wire extending through the housing unit, a lid, and a cartridge cleaning tool, wherein the housing unit and the lid define a lengthwise slit opening extending along the direction of the lengthwise edge of the housing unit and wherein the cartridge cleaning tool is configured to slidably mate with the lengthwise edge housing unit and to extend through the lengthwise slit opening, removing a toner cartridge having a slot for the protrusion of the handle of the cartridge cleaning tool, grasping the handle of the cleaning tool, sliding the handle to move the cartridge cleaning tool from an initial position along the lengthwise slit opening in the longitudinal direction of the corona wire, sliding the handle to move the cleaning tool back to the initial position along the lengthwise slit opening, and replacing the toner cartridge.

* * * * *